US006997322B2

(12) United States Patent
Peterson

(10) Patent No.: US 6,997,322 B2
(45) Date of Patent: Feb. 14, 2006

(54) ORGANIZER

(76) Inventor: Diana C. Peterson, 2315 Edward Rd., Palm Beach Gardens, FL (US) 33410

( * ) Notice: Subject to any disclaimer, the term of this patent is extended or adjusted under 35 U.S.C. 154(b) by 0 days.

(21) Appl. No.: 10/709,422

(22) Filed: May 4, 2004

(65) Prior Publication Data

US 2005/0247591 A1 Nov. 10, 2005

(51) Int. Cl.
*A47K 5/08* (2006.01)

(52) U.S. Cl. ..... 206/581; 206/494; 206/233; 206/457; 206/479; 206/475

(58) Field of Classification Search ..... 206/457, 206/494, 233, 361, 581; 446/75, 71, 479, 446/476, 475; 229/116.4; D9/636; D3/271.6; D21/506, 507
See application file for complete search history.

(56) References Cited

U.S. PATENT DOCUMENTS 3,178,060 A * 4/1965 Bossack ..... 222/78
3,589,724 A * 6/1971 Barlow et al. ..... 273/440
3,623,285 A * 11/1971 Kelly ..... 52/36.2
D262,047 S * 11/1981 Lewis et al. ..... D21/507
D266,809 S * 11/1982 Rodriguez ..... D6/518
4,662,519 A * 5/1987 Ciociola ..... 206/457
D310,395 S * 9/1990 Maloney, II ..... D21/511
4,976,645 A 12/1990 Wesson
5,078,642 A 1/1992 Glessner
5,675,859 A 10/1997 Barr
D394,772 S * 6/1998 Tungol et al. ..... D6/534
5,779,046 A 7/1998 Plaskos
6,037,871 A 3/2000 Babylon
6,237,858 B1 * 5/2001 Lewis ..... 239/18
6,769,538 B2 * 8/2004 Oswald ..... 206/77.1
2003/0088933 A1 * 5/2003 Woods et al. ..... 15/167.1

* cited by examiner

*Primary Examiner*—Mickey Yu
*Assistant Examiner*—Jerrold Johnson
(74) *Attorney, Agent, or Firm*—Michael Lawrence Greenberg ES; Greenberg & Lieberman LLC

(57) ABSTRACT

A bathroom organizational assembly is presented for organizing the bathroom vanity area. The bathroom assembly creates an organized method of organizing bathroom toiletries such as tooth-brushes, combs, lotions, antibacterial soaps, facial tissue, barrettes, contact lens cases, and practically any other toiletry item. The bathroom organizational assembly consolidates and simplifies daily necessities with an enjoyable theme for the appropriate age group to encourage their usage. Storage and dispensing of items stored in the present invention simulates actions in the theme, to create functional decoration.

6 Claims, 1 Drawing Sheet

ORGANIZER

BACKGROUND OF INVENTION

The present invention relates to an organizational device, more particularly a device used to organize toiletry items.

Oftentimes the vanity area in the home bathroom becomes cluttered because there are so many toiletries and cosmetics in the bathroom. With the need and development of many more cosmetics that are for dental care, skin care, lotions, body scrubs, and perfumes, make up, vitamin supplements and small appliances bathroom vanities . . . are often over stocked with such items. People often try new products that promise to improve the appearance of skin, hair or overall better appearances and spend countless amounts of money on cosmetics and toiletries. Over the past two decades, the cosmetics industry has report an overwhelming increase in revenues generated from the sale of cosmetics, toiletries and health care products.

The problem is that there is no organizational device that does more than organize. Restated, consumers need a device that organizes in addition to appealing to the senses. For example, consumers long for a toothbrush holder that is not simply a toothbrush holder, but can be integrated so as to also provide actual decoration for a bathroom. Moreover, there is a need for a bathroom organizational device that promotes use of the toiletries organized therein. In other words, there is a need to display items so that the items" use actually contributes to the realism of the display to encourage use and entertain. For example, when a user dispenses a product from a display, it is desirable that the action of dispensing contributes and/or coalesces with the display to make the display appear more real, to encourage use and entertain.

U.S. Pat. No. 4,976,645 issued to Wesson on Dec. 11, 1990, is a bubble forming and bath soap dispensing device, but it does not have a place to store combs, lotions, cups, facial tissue, contact lens cases, toothpaste tubes, Q-tips and other toiletries like the present invention. It does not offer the versatile organizational storage like the present invention.

U.S. Pat. No. 5,675,859 issued to Barr on Oct. 14, 1997, is a tooth brush assembly that includes a tooth brush and stand, but it does not include a battery operated tooth brush, nor does it include organizational storage for toiletries, like the present invention.

Numerous other patents of relevant art including U.S. Pat. Nos. 6,037,871; 5,779,046 and 5,078,642 are similar devices related to the storage and protection of toiletry devices, but none of them allow for the storage, enticing design and organizational features that exist in the present invention.

Therefore, despite the attempts made by the relevant devices, there still exists a need for a bathroom organizational device that serves to organize, provides a means of storage for toiletries, entices young children and adults to use necessary toiletries and thereby promotes good health for all users. None of the relevant patents, taken alone or in combination, suggests a design in like or kind to the present invention.

SUMMARY OF INVENTION

The present invention relates to a device that is used to organize toiletries, cosmetics and health care products in the bathroom, although the present invention could also be used in the kitchen or any other area in which organization and art could be fused. It allows the toiletries to remain organized in one place of the bathroom so that they do not appear cluttered. In addition to uncluttering the vanity area of the bathroom, the present invention keeps items centrally located, organizes them so that they do not appear cluttered, and entices children and adults to use more of the necessary toiletries that are designed to maintain proper health.

Bathroom vanities have many toiletry items that make using the bathroom cumbersome and time consuming. The present invention is a theme related organizational device that contains specific area for holding a select combination of a facial tissue box, electric or manual tooth brushes, toothbrush tips, combs, Q-tips, barrettes, earrings, contact lens cases, toothpaste tubes, thermometers, lotion, liquid soap and any other toiletries. Each toiletry can be housed in specific areas of the theme related organizational device.

The present invention can be built around any cartoon character, theme or color scheme. This feature of the present invention would entice smaller children into using the necessary health and cosmetic toiletries housed in the present invention. Some young children may not use a few appropriate toiletries because they may not be within eyesight or readily available.

One preferred embodiment of the present invention will entice children to use the bathroom caddy because of the bright colors, decorative design, age appropriate themes and characters. In that preferred embodiment, the present invention has a battery powered toothbrush included with a character oriented theme to entice children to use the toothbrush more often and this would promote better oral hygiene. In another embodiment, the present invention will have a storage area for toothbrushes and/or tooth-brush tips. The method of attaching the toothbrushes to the present invention would also provide adequate ventilation and drying in the vertical position and to deter growth of microorganisms.

The present invention provides easy access to bar soap, liquid soap and/or antibacterial lotion all stored within the present invention with an enticing, age appropriate theme. This will promote more frequent hand washing and hopefully prevent a higher incidence for the spread of germs and again better hygiene.

The present invention also has a tissue dispenser that is related to the theme. This promotes increased usage thereby prevents a higher incidence of the spread of germs. The present invention has a shell casing that could be used as a disposable cup dispenser. This cup dispenser is easily accessible for the user. This deters the use of other non-disposable drinking apparatus that may collect germs from the inability to be properly cleansed. The present invention has a shell casing that could hold miscellaneous toiletries such as combs and/or brushes, i.e. conveniently and related to the theme. This entices more frequent use, and thus, promotes good hygiene practices and perhaps better self-esteem. The toiletries have placements in the present invention to complement the scene, as opposed to detracted from it.

DETAILED DESCRIPTION

Figure 1:
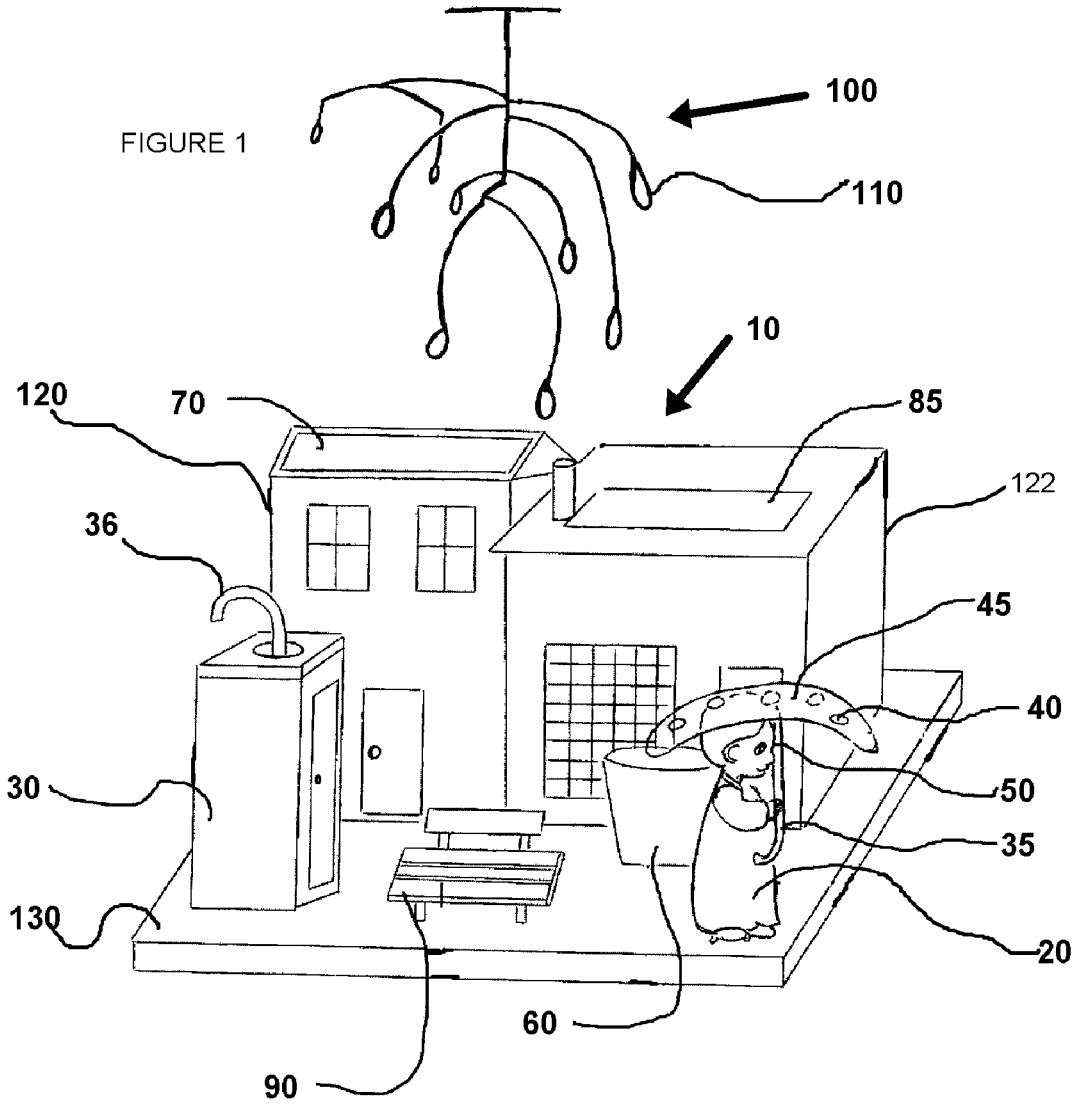
FIG. 1 shows an environmental perspective view of the present invention.

The present invention, as shown in FIG. 1 in the preferred embodiment, depicts a typical street scene. The street scene has several notable characteristics that are common things that one sees on a typical street, such as buildings, a sidewalk, a pedestrian, a trash receptacle, and a bench.

The miniature version of a typical street scene is depicted in the present invention. In the present invention, there are buildings 120, 122, a sidewalk 130, a pedestrian 20, a trash receptacle 60, and a bench 90. The street scene theme can be replaced with other scene or theme type appearances depending on the embodiment chosen by the user.

In the preferred embodiment of the present invention, as shown in FIG. 1, buildings 120 and each part of the street scene has a useful part in the present invention, even though the street scene itself is decorative. The present invention preferably has areas to hold the following toiletry items: manual or battery operated toothbrushes, toothbrush head attachments, a tissue holder, a disposable cup, a tall dispenser that can dispense liquid soap or lotion, a storage area for combs, cosmetic brushes, a thermometer slot, and a flat area that can hold earring, barrettes, contact lens case, toothpaste, or other toiletries that should be readily accessible in the vanity area of the bathroom. The present invention can include a combination of any of the aforementioned features, and the present invention can be used to store other toiletries that can fit these various areas.

The user can choose to have lotion or liquid soap dispenser 30, trash receptacle 60, bench 90 and the like positioned in various arrangements within a street scene, as conventional attachment means holds such items to sidewalk 130. The possible combinations are determined by the needs of the user. All possible combinations of items will share the same character, color scheme, selected theme.

The present invention preferably employs a character as the pedestrian 20, and the theme of the character is then incorporated into a useful method of organization for the bathroom vanity area. The pedestrian 20 and color scheme is age appropriate, whether for a small child or an older user. Some of the possible alternative embodiments are described below.

In one embodiment, the present invention has a character depicted as a pedestrian 20 in the preferred embodiment, (a cartoon character, or a television personality, or other person or animal to entice children to use the contents stored in the present invention, or age appropriate person) and a central theme around the pedestrian 20 is embodied in bathroom assembly 10. The pedestrian 20 is a well-known, age appropriate character, known to entice the interest and spark the attention of small children, teen or an older user.

The present invention has the pedestrian 20 holding an elongated object 35 related to the theme of the bathroom assembly 10, and elongated object 35 attaches to toothbrush holder 45 with holes 40 to hold conventional toothbrushes. In an alternative embodiment, the pedestrian 20 serves as a holder for a conventional character-styled electric or battery operated toothbrush also related to the theme of the bathroom assembly 10. To do such, the conventional character-styled electric or battery operated toothbrush could fit within any aperture carved or molded in pedestrian 20. Toothbrush holder 45 keeps all conventional toothbrushes and/or toothbrush tips centrally located and hung in a vertical position that allows for adequate drying, also preventing microorganisms from growing thereon. The present invention can also have a storage slot 50 for a thermometer, such that storage slot 50 extends within elongated object 35.

The present invention has an area resembling a trash receptacle 60 as it relates to the street scene theme or some type of circular encasement that would dispense disposable cups. This would allow disposable cups to be readily available to the user.

The present invention also has an area for dispensing Q-tips. In an alternative embodiment, the circular encasement, as shown in FIG. 1 as a trash receptacle 60 can be used to dispense other toiletry items, such as Q-tips or be a place to hold barrettes. In other embodiments the circular encasement will be related to the theme type appearances depending on the embodiment chosen by the user. Importantly, the use of trash receptacle 60 to hold cups, Q-tips, or barrettes simulates an actual trash can holding pieces of garbage; and thus, the scene becomes more realistic as simulated trash—cups, Q-tips, or barrettes—is inserted and removed.

First building 120 has a removable receptacle 70 for conventional cosmetic combs and brushes. Removable receptacle 70 can be used to hold any other larger cosmetic device that could fit into the deep removable receptacle 70, such as tall combs, tubes, and brushes. The placement and removal of cosmetic combs, brushes, and tubes within removable receptacle 70 simulates the antennae, aerials, and flumes typically seen atop conventional buildings. Thus, by using removable receptacle 70, the user contributes to the overall realistic look of the scene by making building 120 appear more realistic the more combs, tubes, and brushes are placed in removable receptacle 70.

Second building 122 holds a conventional tissue box and there is a slit 85 on top of second building 122 where tissues are dispensed from within second building 122. Bathroom assembly 10 can be taken apart and each part will be removable for proper cleaning. When the user removes tissues from second building 122 via slit 85, the tissues simulate smoke or steam rising from the top of building 122. Thus, by using second building 122, the user contributes to the overall realistic look of the scene by making second building 122 appear to actually function.

The bench 90 allows a small flat surface for smaller items such as earrings, barrettes, contact lens cases or any other small device that could fit on a flat surface. The bench 90 offers an open, slotted area alternatively that toothbrush and/or toothbrush heads could be placed to dry with appropriate ventilation. Or small combs and/or tubes of toothpaste can also occupy the bench 90. Much like a real street scene in which the user might see items temporarily placed on an actual bench, the bench 90 offers an appropriate place within bathroom assembly 10 for short term storage of items.

A phone booth 30 serves as a conventional liquid/antibacterial soap dispenser. The phone booth 30 has a simulated phone line 36 that is actually the top of a conventional soap dispenser pump. As the user pumps soap from phone line 36 out of phone booth 30, the user simulates phone data moving through a conventional phone line, adding to the realism of the street scene of the bathroom assembly 10. Using the phone booth 30 is very easy and convenient for the user to get access to liquid soap or lotion, and the beauty of art meshed with function in the street scene promotes frequent hand washing.

The present invention can have a mobile 100, in keeping with the street scene. The mobile 100 is related to the theme and adds a unique idea to the bathroom area. Continuing the concept of rain introduced with toothbrush holder 45 resembling an umbrella, the mobile 100 has simulated raindrops 110. The mobile 100 is preferably made of a non-crystal, non-light reflecting material. If however, the mobile 100 is made of a crystal light catching and reflecting material that causes a shimmering in the glow of conventional vanity lights, the present invention must carry appropriate warnings and disclosures because of the possibility of inducing seizures. Using materials that do not reflect light is thus preferable. Simulated raindrops 110 can be scented beads to again blend form and function. While simulated raindrops 110 appear as conventional rain drops, they would also scent the air rather appropriate for a bathroom. Mobile 100 can be mounted upon bathroom assembly 10 in any conventional fashion, or alternatively, mobile 100 can be mounted separately from bathroom assembly 10 so that it hangs above it.

The present invention can made of several types of material. If the preferred embodiment is for an adult, perhaps ceramics material is more enticing. In the preferred embodiment for children, the material should be a durable, washable material that is plastic or a hard molded rubber.

It is intended and should be understood that the present invention is not limited solely to the particular embodiments aforementioned. The detailed description is simply to be illustrative, and the present invention should be viewed to encompass any and all embodiments that fall within the scope of the following claims.

What is claimed is:

1. An organizer comprising:

a base simulating a sidewalk and/or a street;

a simulated first building in communication with the base;

a cosmetic device stored in the simulated first building, the cosmetic device simulating a typical protrusion from a building;

a simulated second building in communication with the base;

one of a toiletry or a soap stored in the simulated second building for dispensing therefrom.

2. The organizer of claim 1, wherein the one of a toiletry or a soap stored in the simulated second building is tissue simulating smoke or steam.

3. The organizer of claim 1, wherein:

the simulated second building is a simulated phone booth; and the one of a toiletry or a soap stored in the simulated second building is soap capable of being dispensed from the simulated phone booth to simulate data movement.

4. The organizer of claim 1, further comprising a simulated bench providing flat storage, the simulated bench being in communication with said base.

5. The organizer of claim 1, further comprising a character holding an umbrella for holding toothbrushes, the character holding an umbrella being in communication with said base.

6. The organizer of claim 1, further comprising a trash receptacle, the trash receptacle being in communication with said base.

* * * * *